US008638231B2

(12) United States Patent
Zheng et al.

(10) Patent No.: US 8,638,231 B2
(45) Date of Patent: Jan. 28, 2014

(54) AUTHENTICATION APPARATUS, AUTHENTICATION METHOD, AND COMPUTER READABLE STORAGE MEDIUM

(75) Inventors: Mingxie Zheng, Kawasaki (JP); Eigo Segawa, Kawasaki (JP); Morito Shiohara, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 957 days.

(21) Appl. No.: 12/572,608

(22) Filed: Oct. 2, 2009

(65) Prior Publication Data

US 2010/0134310 A1 Jun. 3, 2010

(30) Foreign Application Priority Data

Nov. 28, 2008 (JP) ..... 2008-304713

(51) Int. Cl.
*G08B 21/00* (2006.01)

(52) U.S. Cl.
USPC ..... 340/686.1; 340/5.52; 340/5.74

(58) Field of Classification Search
USPC ..... 340/686, 5.2, 5.52, 5.6, 5.61, 5.74, 340/5.53, 686.1; 382/115, 124, 116
See application file for complete search history.

(56) References Cited

U.S. PATENT DOCUMENTS

| | | | | |
|---|---|---|---|---|
| 6,069,655 | A * | 5/2000 | Seeley et al. | 348/154 |
| 6,310,966 | B1 * | 10/2001 | Dulude et al. | 382/115 |
| 6,954,553 | B2 * | 10/2005 | Ikegami | 382/224 |
| 7,158,657 | B2 * | 1/2007 | Okazaki et al. | 382/118 |
| 2004/0086157 | A1 * | 5/2004 | Sukegawa | 382/115 |
| 2005/0212654 | A1 | 9/2005 | Yoda | |
| 2006/0126906 | A1 * | 6/2006 | Sato et al. | 382/118 |
| 2006/0204050 | A1 * | 9/2006 | Takizawa | 382/115 |
| 2007/0050637 | A1 | 3/2007 | Arai et al. | |
| 2009/0060293 | A1 * | 3/2009 | Nagao et al. | 382/118 |

FOREIGN PATENT DOCUMENTS

| | | | |
|---|---|---|---|
| JP | 11-66319 | | 3/1999 |
| JP | 2000-197036 | | 7/2000 |
| JP | 2003-303312 | | 10/2003 |
| JP | 2005-146709 | | 6/2005 |
| JP | 2005-387417 | * | 6/2005 |
| JP | 2005-258731 | | 9/2005 |
| JP | 2006-164020 | | 6/2006 |
| JP | 2007-66107 | | 3/2007 |
| JP | 2007-303239 | | 11/2007 |

OTHER PUBLICATIONS

Office Action issued by the Japanese Patent Office on Mar. 26, 2013 in corresponding Japanese patent application No. 2008-304713.
Extended European Search Report issued by the European Patent Office on Jul. 10, 2013 in corresponding European patent application No. 09173014.3.

* cited by examiner

*Primary Examiner* — Daniel Previl
(74) *Attorney, Agent, or Firm* — Staas & Halsey LLP

(57) ABSTRACT

An authentication apparatus includes a registration unit that registers authentication information representing a check target, a first authentication unit that authenticates the check target at the entrance of the check target to a first area, a second authentication unit that authenticates the check target at the entrance of the check target to a second area after being authenticated by the first authentication unit, and a detector that detects a check target present in a detection area and expected to be authenticated by the second authentication unit. The second authentication unit retrieves, from the registration unit, registration information of the check target detected by the detector, and authenticates the check target authenticated by the first authentication unit using the registration information.

12 Claims, 12 Drawing Sheets

FIG. 6

80,6

| ID NUMBER | NAME | BIOMETRIC INFORMATION DATA |
|---|---|---|
| 001 | USER A | *#* * * |
| 002 | USER B | * * * *# |
| ⋮ | ⋮ | ⋮ |
| N | USER N | ##### |

82 84 86

FIG. 7

90,34

92

ID NUMBER: N (USER N) — 90N

| PRESENT POSITION (x,y) | PRECEDING POSITION (x,y) | TIME |
|---|---|---|
| (25,42) | | |
| (28,45) | | |
| (35,48) | | |
| ... | | |

ID NUMBER: 002 (USER B) — 902

| PRES POSIT (x, |
|---|
| (25, |
| (28, |
| (30, |
| .. |

ID NUMBER: 001 (USER A) — 901

| PRESENT POSITION (x,y) | PRECEDING POSITION (x,y) | TIME |
|---|---|---|
| (25,40) | (20,40) | 13:30:00 |
| (28,45) | (25,40) | 13:31:00 |
| (30,48) | (28,45) | 13:32:00 |
| ... | ... | ... |

94 96 98

FIG. 8

100,32

| ID NUMBER | NAME | PRESENT POSITION (x,y) | TIME | BIOMETRIC INFORMATION DATA |
|---|---|---|---|---|
| 003 | USER C | (25,50) | 13:32:00 | * * * * * |
| 001 | USER A | (20,40) | 13:32:00 | * # * * * |
| ⋮ | ⋮ | ⋮ | ⋮ | ⋮ |
| 82 | 84 | 94 | 98 | 86 |

FIG. 11

102,34

104

ID NUMBER: N (USER N) — 102N

| PRESENT POSITION (x,y) | TIME | PROXIMITY ID | PROXIMITY ID NUMBER |
|---|---|---|---|
| (25,42) | | | |
| (28,50) | | | |
| (35,48) | | | |
| ... | | | |

ID NUMBER: 002 (USER B) — 1022

ID NUMBER: 001 (USER A) — 1021

| PRESENT POSITION (x,y) | TIME | PROXIMITY ID | PROXIMITY ID NUMBER |
|---|---|---|---|
| (25,40) | 13:30:00 | YES | 002 |
| (28,45) | 13:31:00 | NO | – |
| (30,48) | 13:32:00 | NO | – |
| ... | ... | ... | ... |

106 108 110 112

FIG. 12

120,32

| ID NUMBER | POSITION (x,y) | TIME | BIOMETRIC INFORMATION DATA | PROXIMITY ID NUMBER | BIOMETRIC INFORMATION OF PROXIMITY ID |
|---|---|---|---|---|---|
| 003 | (25,50) | 15:35 | * * * * * | – | – |
| 001 | (20,40) | 15:35 | * # * * * | 002 | * * * * # |
| ⋮ | ⋮ | ⋮ | ⋮ | ⋮ | ⋮ |

122 124 126 128 130 132

FIG. 14

140,34

141

ID NUMBER: N (USER N) — 140N

| PRESENT POSITION (x,y) | TIME | PROXIMITY ID | PROXIMITY ID NUMBER |
|---|---|---|---|
| (25,42) | | | |
| (28,50) | | | |
| (35,48) | | | |
| ... | | | |

ID NUMBER: 002 (USER B) — 1402

| PRES POSIT (x, |
|---|
| (25, |
| (28, |
| (30, |
| .. |

ID NUMBER: 001 (USER A) — 1401

| PRESENT POSITION (x,y) | TIME | PROXIMITY ID | PROXIMITY ID NUMBER |
|---|---|---|---|
| (25,40) | 13:30:00 | NO | – |
| (28,45) | 13:31:00 | NO | – |
| (30,48) | 13:32:00 | NO | – |
| ... | ... | ... | ... |

142 144 146 148

FIG. 15

150,32

| ID NUMBER | POSITION (x,y) | TIME | BIOMETRIC INFORMATION DATA |
|---|---|---|---|
| 001 | (20,40) | 15:35 | * # * * * |
| ⋮ | ⋮ | ⋮ | ⋮ |

AUTHENTICATION APPARATUS, AUTHENTICATION METHOD, AND COMPUTER READABLE STORAGE MEDIUM

CROSS-REFERENCE TO RELATED APPLICATIONS

This application is based upon and claims the benefit of priority from the prior Japanese Patent Application No. 2008-304713 filed on Nov. 28, 2008, the entire contents of which are incorporated herein by reference.

FIELD

The embodiments discussed herein relate to an authentication apparatus for use in a high-security entrance and exit control system, or the like. In particular, the embodiments relate to an authentication apparatus, an authentication method, and a computer-readable storage medium for performing an authentication process with check targets narrowed through authentication phases.

BACKGROUND

In high-security layered-type buildings, individuals are identified through personal authentication so that authorized persons only are allowed to enter rooms. In such a case, an authentication apparatus needs to be installed at each door to monitor reliably who enters which room. Security, convenience, a high authentication accuracy, a high authentication speed, and user-friendliness are required of such an authentication apparatus.

A 1:1 authentication method is known as one authentication method used in authentication apparatuses is known. In the 1:1 authentication method, an individual is identified in response to the inputting of an ID (identification) number, and a checking process is performed using pre-registered biometric information of the individual. A 1:N authentication method is also known as a biometric authentication method. In the 1:N authentication method, a checking process is performed against all registered biometric information data without the need for the inputting the ID number of each individual.

Japanese Unexamined Patent Application Publication No. 2007-66107 discloses a shortening technique of check time in biometric authentication. According to the disclosure, a tag reader is used to read ID numbers from radio frequency IC (RFID) tags of persons present in a certain area and wishing to enter the room.

Japanese Unexamined Patent Application Publication No. 2007-303239 discloses an entrance and exit control technique using a person tracking camera or an authentication camera. According to the disclosure, a person photographed by the tracking camera is assigned ID0002-0006, and the authentication camera authenticates the face of the person in response to the position of the person. The authentication camera records an authentication state on a per ID basis, and unlocks the door if the tracking camera detects that the person successfully authenticated approaches the door.

Japanese Unexamined Patent Application Publication No. 2003-303312 discloses a person authentication technique of authenticating a person within a limited area. In accordance with the disclosure, a first authentication process based on unique authentication information such as biometric information is performed on a person qualified to access a restricted area S when the person enters or exits the restricted area S. After the first authentication process, a second authentication process is performed on the same qualified person when the same qualified person enters or exits a partition A. The second authentication process is based on authentication information having an authentication level lower than that of the unique authentication information.

Japanese Unexamined Patent Application Publication No. 2005-146709 discloses an authentication apparatus with a camera. In accordance with the disclosure, a card reader or a camera is installed at an entrance or exit (door), and the camera photographs the face of a user who approaches the entrance or exit. Authentication means then authenticates the user. If the user operates the card reader and is then successfully authenticated by the authentication means, passage control means unlocks the door at the entrance or exit.

SUMMARY

An authentication apparatus includes a registration unit that registers authentication information representing a check target, a first authentication unit that authenticates the check target at the entrance of the check target to a first area, a second authentication unit that authenticates the check target at the entrance of the check target to a second area after being authenticated by the first authentication unit, and a detector that detects a check target present in a detection area and expected to be authenticated by the second authentication unit.

The second authentication unit retrieves, from the registration unit, registration information of the check target detected by the detector, and authenticates the check target authenticated by the first authentication unit using the registration information.

The object and advantages of the invention will be realized and attained by means of the elements and combinations particularly pointed out in the claims. It is to be understood that both the foregoing general description and the following detailed description are exemplary and explanatory and are not restrictive of the various embodiments, as claimed.

Additional aspects and/or advantages will be set forth in part in the description which follows and, in part, will be apparent from the description, or may be learned by practice of the various embodiments.

BRIEF DESCRIPTION OF THE DRAWINGS

FIG. 6 depicts an example of a user registration database.

FIG. 7 depicts an example of a person tracking table.

FIG. 8 depicts an example of a crosscheck biometric information table.

FIG. 11 depicts an example of a person tracking table in accordance with the second embodiment.

FIG. 12 depicts an example of a crosscheck biometric information table in accordance with the second embodiment.

FIG. 14 depicts an example of a person tracking table in accordance with the third embodiment.

FIG. 15 depicts an example of a crosscheck biometric information table in accordance with the third embodiment.

DETAILED DESCRIPTION OF THE EMBODIMENT(S)

(First Embodiment)

Figure 1:
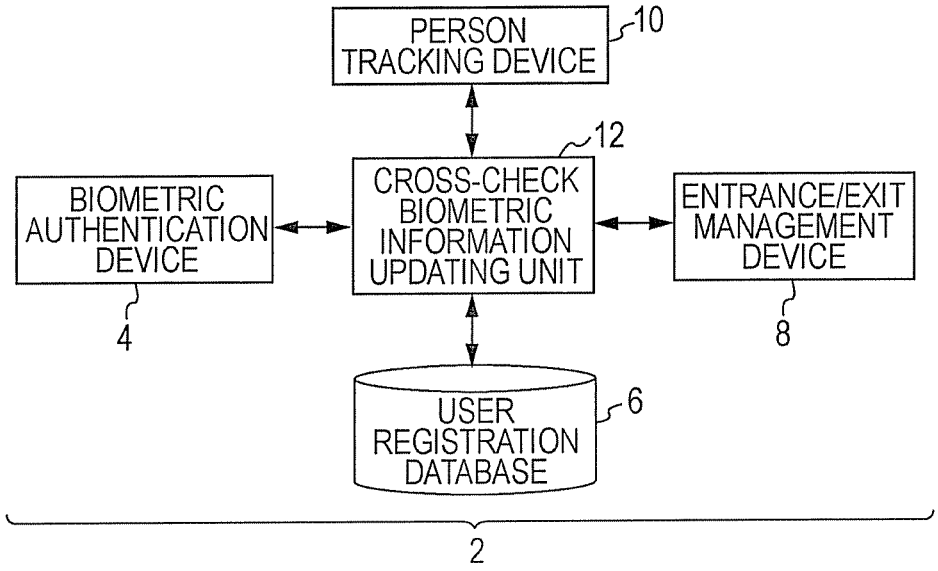
FIG. 1 depicts an authentication system related to a first embodiment.
Figure 2:
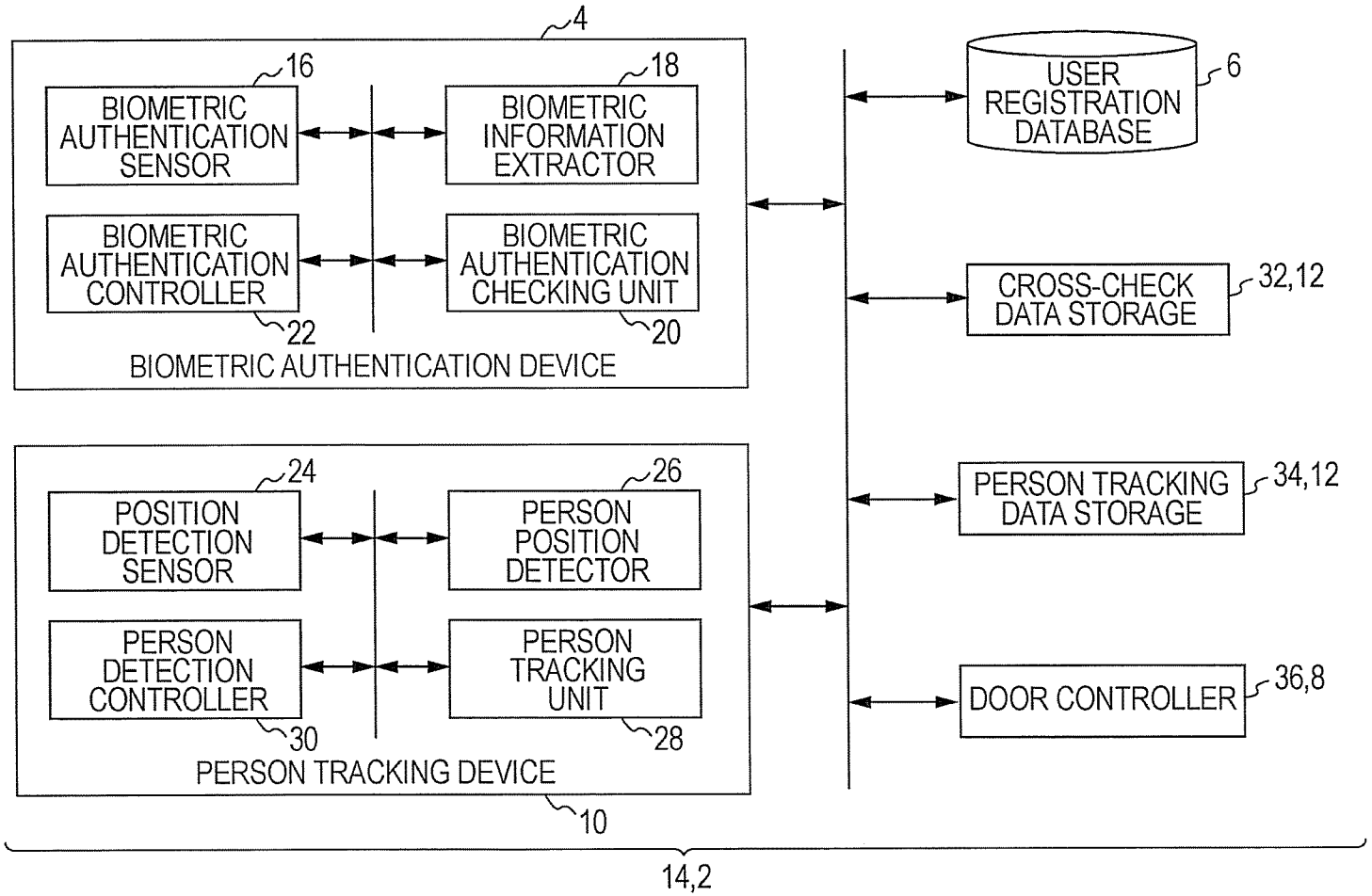
FIG. 2 is a functional block diagram of an authentication apparatus.
Figure 3:
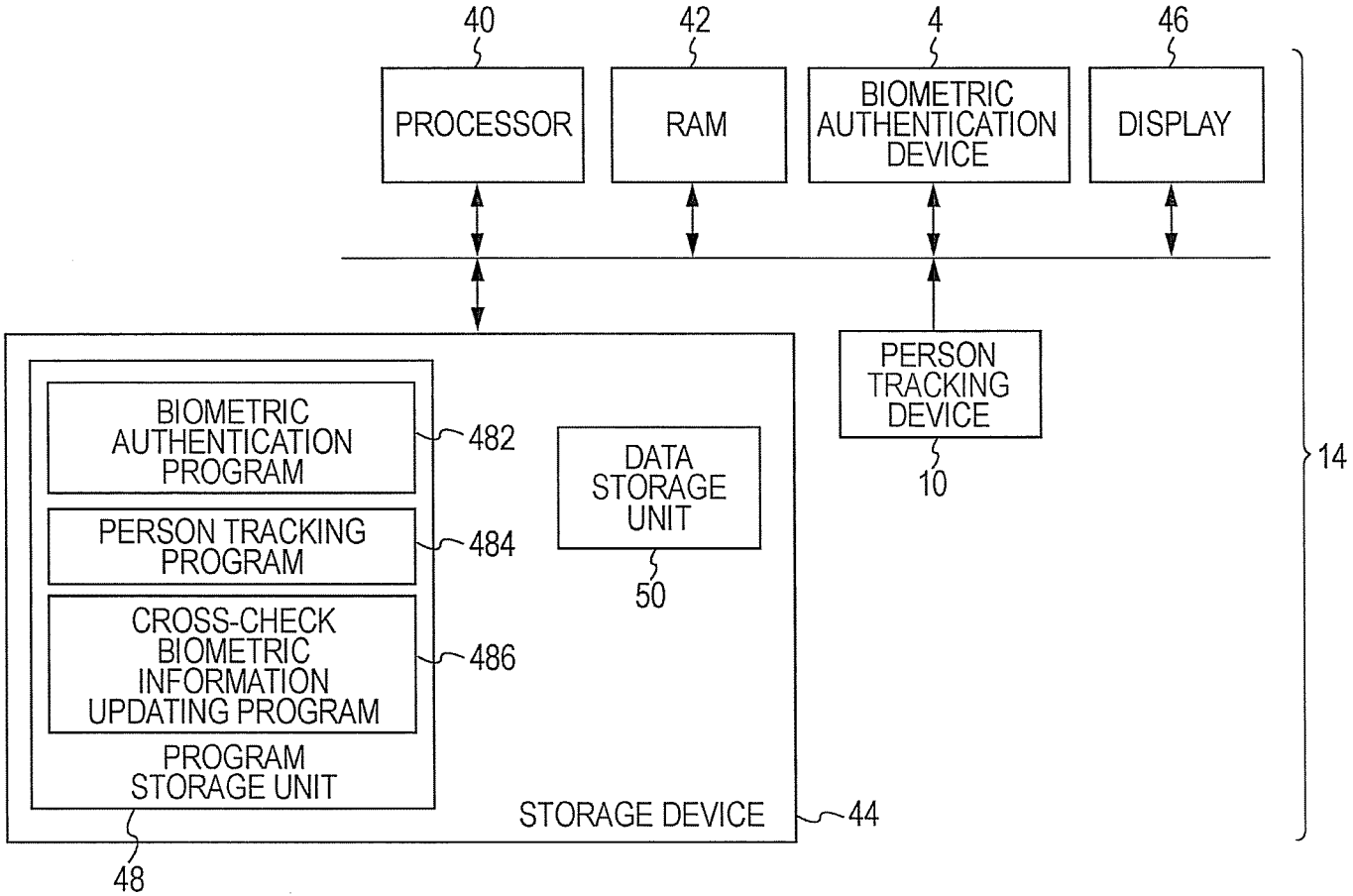
FIG. 3 depicts a hardware structure of a computer forming the authentication apparatus.

A first embodiment is described with reference to FIGS. 1-3. FIG. 1 depicts an authentication system of the first embodiment. FIG. 2 is a functional block diagram of an authentication apparatus. FIG. 3 depicts a hardware structure of a computer forming the authentication apparatus. The structure depicted in FIGS. 1-3 is one example and the invention is not limited to the depicted structure.

An authentication system 2 performs a multi-phase authentication process using biometric information in a plurality of areas requiring tight security, thereby controlling entrance and/or exit. The authentication system 2 narrows check targets under a certain condition. The authentication system 2 is one example of an authentication apparatus. For example, the authentication system 2 includes a biometric authentication device 4, a user registration database 6, an entrance and exit management device 8, a person tracking device 10, and a crosscheck biometric information updating unit 12.

The biometric authentication device 4 is one example of the authentication apparatus that authenticates whether a person is allowed to enter a room. In the authentication process, the biometric authentication device 4 uses fingerprint information of fingers, vein information, or iris information of the person, for example. The authentication system 2 performs the above-described multi-phase authentication. For example, in the case of entrance and exit management, the biometric authentication device 4 is installed at each floor, and the authentication system 2 stores authentication information, etc.

The user registration database 6 is one example of a registration unit of the authentication system 2. The user registration database 6 stores an ID (Identification) number of each user who is authenticated by the biometric authentication device 4 as an authorized user, and biometric information data of the authorized user collected in advance. In the authentication of the check targets, the user registration database 6 inputs and outputs the registration information thereof as necessary.

The entrance and exit management device 8 performs unlock control on each door of a room managing entrance and exit in response to the authentication results of the biometric authentication device 4 and instructs the user registration database 6 to record entrance and exit.

The person tracking device 10 managing entrance and exit to a room or the like serves as a tracking unit tracking a person present within the room after being authenticated, or as a detector detecting the check target in a predetermined area. The person tracking device 10 collects tracking information such as a present position and movement information of a person within the room.

The crosscheck biometric information updating unit 12 is an example of a processor for narrowing crosscheck data for use in biometric authentication. The crosscheck biometric information updating unit 12 sets a crosscheck condition, based on the tracking information collected by the person tracking device 10 and entrance and exit information and the like stored the entrance and exit management device 8. The crosscheck biometric information updating unit 12 then retrieves the registration information satisfying the crosscheck condition from the user registration database 6. More specifically, the crosscheck biometric information updating unit 12 is a controller of the authentication system 2.

FIG. 2 is a functional block diagram of an authentication apparatus 14. The authentication apparatus 14 is an example of a functional structure of the authentication system 2. The authentication apparatus 14 includes biometric authentication device 4, user registration database 6, person tracking device 10, crosscheck data storage 32, person tracking data storage 34, and door controller 36. The biometric authentication device 4 includes biometric authentication sensor 16, biometric information extractor 18, biometric authentication checking unit 20, and biometric authentication controller 22. The biometric authentication sensor 16 is a fingerprint sensor, a vein sensor, or the like. The biometric information extractor 18 extracts the registration information for use in authentication in accordance with data obtained by the biometric authentication sensor 16. The biometric authentication checking unit 20 checks biometric information extracted by the biometric information extractor 18 against check target data. The biometric authentication controller 22 determines the authentication results of the biometric authentication checking unit 20 and controls a biometric authentication process. In the authentication apparatus 14, the biometric information extractor 18 extracts the biometric information of a user in accordance with the data obtained by the biometric authentication sensor 16, the biometric authentication checking unit 20 checks the biometric information of the user against the registration information data, and the biometric authentication controller 22 performs a determination step on the check results.

The person tracking device 10 is one example of the detector detecting a person in a particular room or the like. The person tracking device 10 includes position detection sensor 24, person position detector 26, person tracking unit 28, and person detection controller 30. The position detection sensor 24 may be a camera, an ultrasonic sensor, a floor pressure sensor, or the like. The person position detector 26 detects the position of a person within the room based on detection information from the position detection sensor 24. The person tracking unit 28 tracks information such as a movement direction of an identified person. The person detection controller 30 issues a control instruction to each element of the person tracking device 10 and identifies a person within an area according to which check targets are narrowed in the authentication to be discussed later.

The person tracking device 10 identifies the position of the person and tracks the movement of the person using the position detection sensor 24 as described above. A specific process is disclosed in Japanese Unexamined Patent Application Publication No. 11-066319. In the identification and detection of a mobile object using cameras as disclosed, a plurality of cameras photograph the mobile object, a feature point is extracted from obtained images, and the feature point is tracked. In the detection process, stereo correspondence is performed at the feature points in the images taken by the cameras. Spatial coordinates of the feature point are calculated, and a movement line indicating the path of the feature point in the spatial coordinates is determined. Movement lines near to each other in distance are connected to each other.

Japanese Unexamined Patent Application Publication No. 2000-197036 discloses a specific example of position tracking. As disclosed, in the position tracking, an inter-image absolute value difference calculator and an inter-image normalization correlation calculator perform calculations on a plurality of shade gradation time series data units from an image capturing device, and the images obtained by these calculators are AND-gated. Further in the position tracking process, a plurality of frames of images obtained as a result of AND gating are accumulated and summed, and then binarized. Further in the position tracking process, extraction operations of features including the center of gravity, area, angle of principal axis of inertia, label data, etc. are performed. Feature quantities stored in time series are mutually compared with each other in order to detect the movements and positions of humans and non-human objects.

Japanese Unexamined Patent Application Publication No. 2006-164020 discloses a specific example of a position tracking method with a pressure sensor. In this method, a pressure sensor embedded under floor detects a pressure applied by the underside of the feet of a walker, and identification and movement path of the walker are thus calculated based on the detected pressure.

The crosscheck data storage 32 is an element of the crosscheck biometric information updating unit 12. In each phase of the multi-phase authentication, the crosscheck data storage 32 stores information of the check targets at a preceding phase so that the information is referenced at the next phase. In the narrowing operation of the biometric information to be discussed later, the crosscheck data storage 32 stores as an authentication target the biometric information of the person within the predetermined area of the biometric authentication device 4.

The person tracking data storage 34 is an element of the crosscheck biometric information updating unit 12. The person tracking data storage 34 stores a person tracking table to be discussed later (FIGS. 7, 11, and 14) as information of the present position of the person within the room. The position information of the person tracking table is used in the narrowing operation of the biometric information.

The door controller 36 is one element of the entrance and exit management device 8. The door controller 36 controls the door for locking or unlocking in response to a notification of the authentication results.

As depicted in FIG. 3, the authentication apparatus 14 may include a computer including, for example, processor 40, random-access memory (RAM) 42, biometric authentication device 4, person tracking device 10, storage device 44, display 46, etc.

The processor 40 is a processor executing an operating system (OS) running the computer, and a variety of application programs. The processor 40 is a central processing unit (CPU), for example. The processor 40 together with the RAM 42 serves as the function element of each the crosscheck biometric information updating unit 12 and the entrance and exit management device 8.

The RAM 42 serves as a working area for executing a calculation process and the like. The RAM 42 allows each control program stored on the storage device 44 to operate so that the biometric authentication device 4, the person tracking device 10, the crosscheck biometric information updating unit 12, the entrance and exit management device 8, etc. function.

The storage device 44 includes a program storage unit 48 and a data storage unit 50, for example. The program storage unit 48 stores programs causing the elements of the authentication apparatus 14 to function. In addition to the OS, the program storage unit 48 stores a biometric authentication program 482, a person tracking program 484, a crosscheck biometric information updating program 486, etc. The biometric authentication program 482 sends a control instruction to and receives authentication data, tracking data, etc. from each of the biometric authentication device 4 and the person tracking device 10. The crosscheck biometric information updating program 486 narrows the check targets as will be described later. The data storage unit 50 stores data detected by the biometric authentication device 4 and the person tracking device 10.

The display 46 is one example of an information presentation unit. The display 46 is a liquid-crystal display (LCD), for example, and displays the authentication results.

Figure 4B:
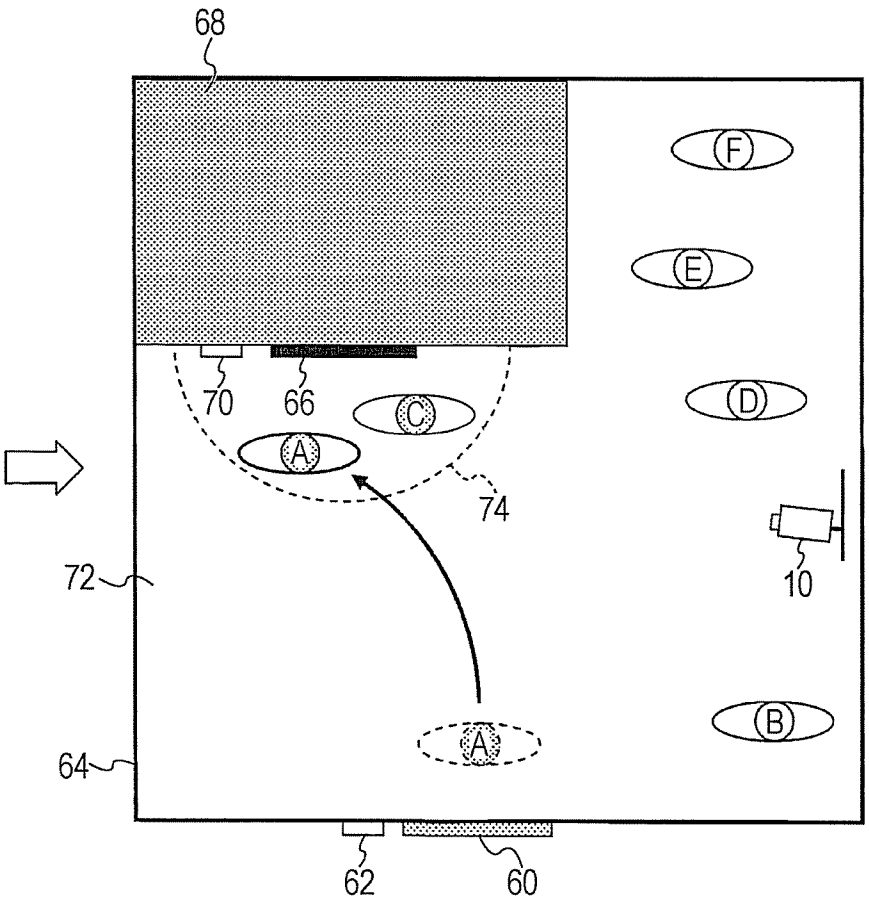
FIGS. 4A and 4B depict the movement of users within a first area in accordance with the first embodiment.
Figure 4A:
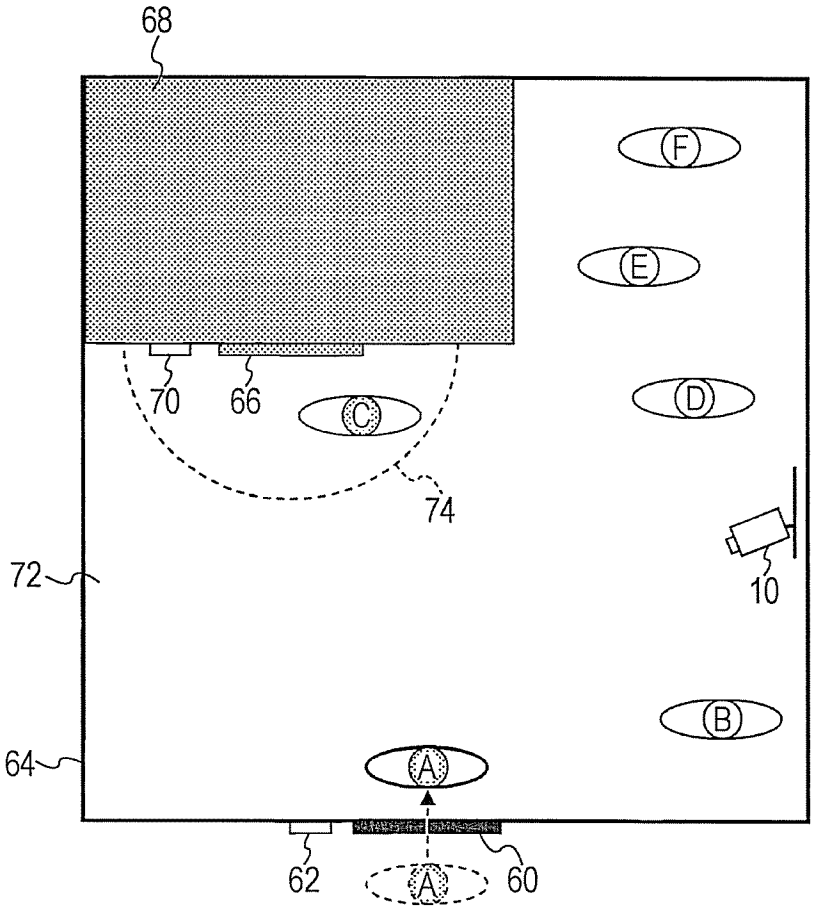

The movements of the users having been authenticated and entered the room and the narrowing operation of the check targets are described with reference to FIGS. 4A and 4B. FIGS. 4A and 4B illustrate the movements of the users within a first area in accordance with the first embodiment. The structure depicted in FIGS. 4A and 4B is one example only, and the invention is not limited to the depicted structure.

FIGS. 4A and 4B illustrate a user A who is entering two partitioned rooms through two-phase authentication apparatuses. A first door 60 and a first authentication apparatus 62 are arranged at a first room 64. A second room 68 opened and closed with a second door 66 is contained in the first room 64. The second room 68 is provided with a second authentication apparatus 70. The first room 64 includes a target tracking area 72 excluding the second room 68. A detection area 74 is set up near the second door 66. The second room 68 is an individual server management room or a data management room requiring a high level of security. In order to enter the second room 68, a user needs to be authenticated by the second authentication apparatus 70 installed at the second door 66 after being authenticated by the first authentication apparatus 62 installed at the first door 60. The user is one example of the check target. The first room 64 is one example of a first area. The second room 68 is one example of a second area. The detection area 74 is one example of a third area partitioned in the first area. The detection area 74 is used as a condition to narrow the check targets as the persons within the detection area 74 expected to be authenticated through the second phase of authentication. In other words, a person who is a potential authenticatee for the second phase of authentication is a person proceeding to or present within the detection area 74. In accordance with the embodiment, the second room 68 is partitioned in the first room 64. Alternatively, the first room 64 and the second room 68 may be separately partitioned with the second door 66 connecting the two rooms.

The first authentication apparatus 62 is one example of a first authentication unit. The first authentication apparatus 62 opens the first door 60 to a user who is authenticated by the first authentication apparatus 62. More specifically, the first authentication apparatus 62 controls entrance and exit management of the first room 64. The second authentication apparatus 70 is one example of a second authentication unit. The second authentication apparatus 70 opens the second door 66 under a certain condition to a user who is authenticated by the second authentication apparatus 70 after being authenticated by the first authentication apparatus 62. More specifically, the entrance and exit of the second room 68 are controlled by the authentication apparatuses 62 and 70. Each of the authentication apparatuses 62 and 70 may be the biometric authentication device 4 (FIG. 2).

The position, movement direction, movement status, etc. of a person within the room are tracked in the target tracking area 72. For tracking purpose, one or a plurality of tracking cameras are installed and one or a plurality of pressure sensors are installed at the floor level, as the person tracking device 10 as previously described. In this way, the position information of the person within the target tracking area 72 is acquired on a real-time basis. The person tracking device 10 treats as an XY plane the target tracking area 72 for position fixing or tracking, and represents the position of the person in coordinates of the plane. A person tracking table 90 (FIG. 7) containing a record of history of the person tracked is produced.

Referring to FIG. 4A, the first authentication apparatus 62 performs the 1:N authentication on the user A. If the user A is successfully authenticated in the first authentication, the user A is granted an ID, and can enter the first room 64. The person tracking device 10 starts tracking the user A when the user A enters the first room 64, and records the movement information of the user A. For example, five users B, C, D, E, and F have already been in the first room 64 as illustrated in FIG. 4A. The person tracking device 10 tracks the positions of these users, and records the movement information of these users on the person tracking table 90 (see FIG. 7).

Referring to FIG. 4B, the user A approaches the second authentication apparatus 70 for authentication at the entrance to the second room 68. A predetermined area in the vicinity of the second door 66 or the second authentication apparatus 70 is set as the detection area 74. The second authentication apparatus 70 narrows the check targets to the users present within the detection area 74 and performs the authentication process (the second authentication).

More specifically, the second authentication apparatus 70 narrows the users having entered the first room 64 after being authenticated by the first authentication apparatus 62 to the persons present within the detection area 74 as the potential check targets to be authenticated by the second authentication apparatus 70, and checks the potential check targets against the registration information. In the state depicted in FIG. 4B, the authentication apparatus 14 determines that the persons within the detection area 74 are the user A and the user C, based on the tracking results of the person tracking device 10 as the detector. The authentication apparatus 14 retrieves registration data of the user A and the user C from the user registration database 6 as crosscheck data for the second authentication apparatus 70, and performs the authentication process on the user A using the registration data.

In accordance with the embodiment, a semicircular area centered on the second door 66 is set as the detection area 74. Alternatively, a person standing at coordinates in the XY coordinates plane set by the person tracking device 10 within the first area may be identified as a potential check target. In accordance with the embodiment, the predetermined area having an expansion is set as the detection area 74. Alternatively, an area accommodating a predetermined number of persons may be set up as the detection area 74.

Figure 5:
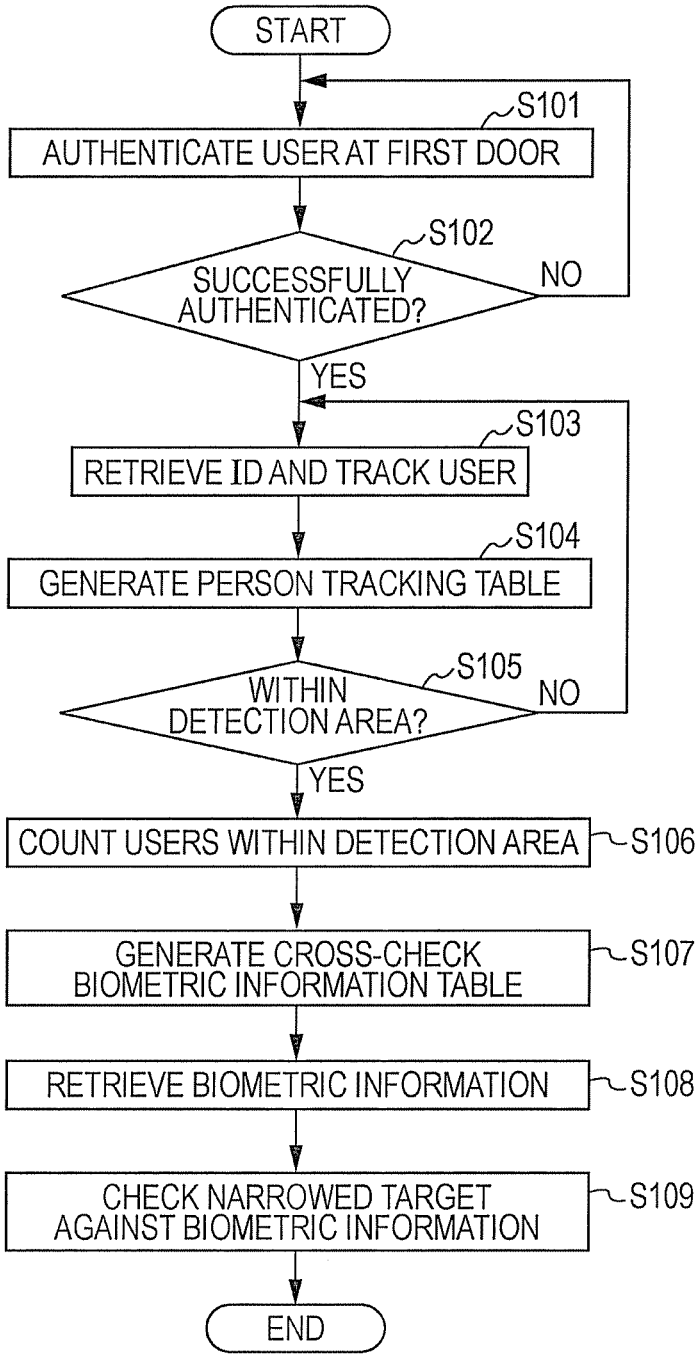
FIG. 5 is a flowchart illustrating a narrowing process of check targets.

The process of the authentication method and authentication program is described below with reference to FIG. 5. FIG. 5 is a flowchart illustrating a narrowing process of the check targets. The process content and process steps are depicted in FIG. 5 exemplary purposes only, and the various embodiments are not limited to the depicted process content and process steps.

As described above, in this process, the user authenticated in the first authentication at the first door 60 is mapped to the ID stored on the user registration database 6 in accordance with the biometric information acquired during the first authentication. The users authenticated through the first authentication are to be authenticated in the second authentication at the second door 66. In this process, the users authenticated through the first authentication are narrowed to the users present within the detection area 74.

In the process of the embodiment as depicted in FIG. 5, the user A is authenticated by the first authentication apparatus 62 at the first door 60 (step S101). If the authentication is unsuccessful (NO in step S102), processing returns to a ready-to-receive state. In the ready-to-receive state, the first authentication apparatus 62 prompts a user who wishes to be authenticated to enter the biometric information and the like.

If the user A has been successfully authenticated (YES in step S102), the successfully authenticated user A and the ID number unique to the user A mapped thereto are stored. The position detection sensor 24 in the person tracking device 10 detects and tracks the position of the user A (step S103). The person tracking table 90 (FIG. 7) is then produced as a history table of the person tracked (step S104). The person tracking table 90 is then stored onto the person tracking data storage 34. The person tracking table 90 (FIG. 7) contains the ID number, the time, the present position, the preceding position, etc. as information of the authenticated person.

It is then determined whether the user A is present within the detection area 74 for the second authentication (step S105). Present position information of the user A stored in the person tracking table 90 (FIG. 7) is used in this determination. If it is determined in step S105 that the user A is present within the detection area 74 (YES in step S105), the other users near the second door 66, i.e., within the detection area 74 are counted (step S106). The registration information of the counted users is retrieved and listed from the user registration database 6 (FIG. 6) to produce a crosscheck biometric information table 100 (FIG. 8). The crosscheck biometric information table 100 is stored onto the crosscheck data storage 32 (step S107).

The crosscheck biometric information table 100 (FIG. 8) lists the ID number, name, present position, time information, biometric information data, etc. of the counted user, and is used as the check target in the second authentication. If the user A enters the detection area 74 at the second door 66 to be authenticated as depicted in FIG. 4B, the user A (person of interest) and the other user C present within the detection area 74 are counted.

The biometric information extractor 18 retrieves the biometric information of the user A (step S108), and checks the biometric information data against the biometric information of the user listed in the crosscheck biometric information table 100 (FIG. 8) in step S109.

In the checking process of the biometric information, the biometric authentication checking unit 20 checks the registered biometric information against the biometric information input by the user, calculates the similarity thereof, and sends the calculation results to the biometric authentication controller 22. The biometric authentication controller 22 then compares the calculated value highest in similarity with a predetermined threshold value, and determines whether the calculated value is equal to or higher than the threshold value. If the determination results show that the similarity is equal to or higher than the threshold value, it is determined that the user having input the biometric information data is the one registered on the user registration database 6. The door controller 36 is so notified and unlocks the second door 66.

If the determination results show that the similarity is lower than the threshold value, it is determined that the user having input the biometric information data is not the one registered on the user registration database 6, and the second door 66 remains locked.

In one feature point method for calculating similarity in the biometric authentication, a feature point such as a branch point or a discontinuity point (end point) is extracted from the registered fingerprint information and the fingerprint information input by the user, and the position, direction, etc. of the feature point are numerized for checking. The calculation method of similarity is not limited to the feature point method. A pattern matching method may also be used for the calculation of similarity. If the biometric information other than the fingerprint information is used, a calculation method appropriate for the biometric information other than the fingerprint information may be used.

A structure of information stored on each database is described below with reference to FIGS. 6-8. FIG. 6 depicts an example of user registration data stored on the user database. FIG. 7 depicts an example of a person tracking table. FIG. 8 depicts an example of a crosscheck biometric table. FIGS. 6-8 depict the registration information and the structure of the tables depicted for exemplary purposes only, and the various embodiments are not limited to the registration information and the table structure depicted herein.

Referring to FIG. 6, the user registration database 6 lists a user database 80 of the users. The user database 80 registers the users eligible for authentication with ID numbers 82, name information 84, biometric information data 86, etc. respectively mapped to the users. In the first authentication, the biometric information input by the user is compared with the biometric information data 86. If the biometric information data 86 shows a similarity higher than a predetermined threshold value, the user is authenticated and the first door 60 is unlocked. Further in the first authentication, the biometric information data 86 and the ID number 82 of the authenticated user, etc. are sent to the person tracking data storage 34 (FIG. 2), and used in the second authentication.

Referring to FIG. 7, a person tracking table 90 (901, 902, . . . , 90N) for the users successfully authenticated through the first authentication is produced on the person tracking data storage 34. The person tracking table 90 stores coordinates 94 of the present position within the target tracking area 72, coordinates 96 of the preceding position, and time information 98 therefor, etc. mapped to the ID number (name) 92.

In the second authentication, the check targets are narrowed to the users within the detection area 74 as the predetermined area of the second door 66 or the second authentication apparatus 70. Referring to FIG. 8, the registration information stored on the user registration database 6 and the information on the person tracking table 90 are combined into the crosscheck biometric information table 100 on the crosscheck data storage 32. The second authentication is performed, by checking with the biometric information data 86 on the crosscheck biometric information table 100.

Moreover, the person tracking table 90 may register information representing the authentication success or failure at each phase of the authentication. More specifically, information indicating that a person having been successfully authenticated through the first authentication but having failed in the second authentication may be added, for example. The users are thus sorted according to their authentication status.

With this arrangement, the first authentication apparatus 62 stores authentication results on a per authentication target basis. The check targets are then narrowed to the persons present within the detection area 74 as eligible for the second authentication. The check time is thus shortened. Since the check targets are reduced, the possibility that a third person is erroneously accepted is lowered. The inputting of an ID number and the constant carrying of an ID tag for the purpose of increasing authentication accuracy or preventing authentication error are not necessary. The burden on the user is thus lightened.

(Second Embodiment)

Figure 9B:
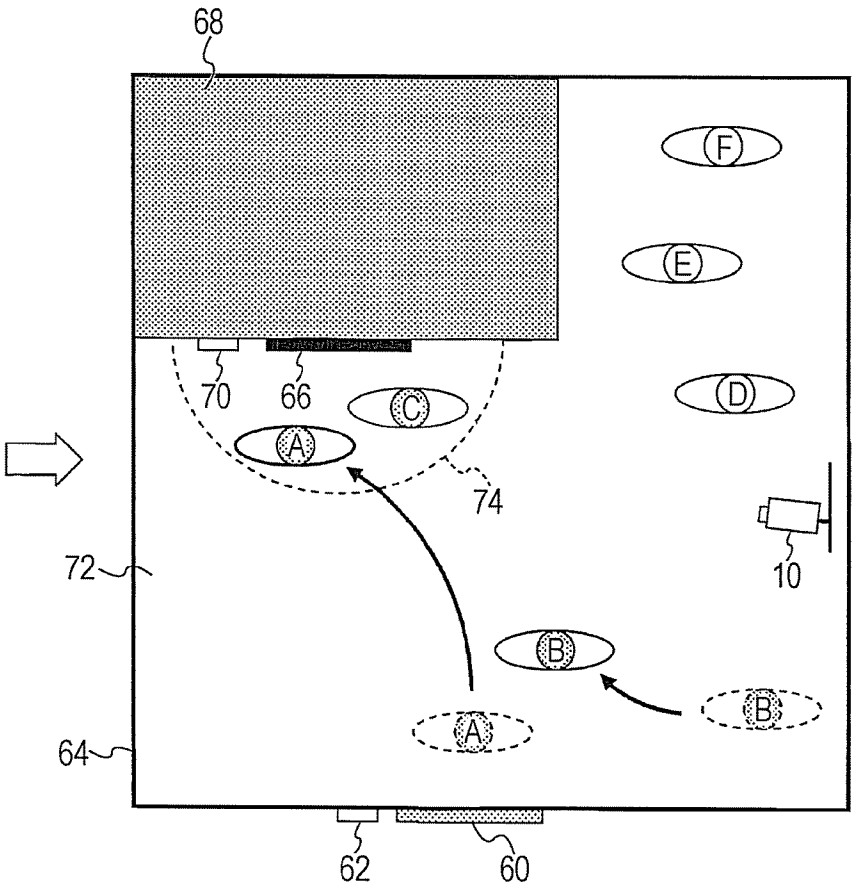
FIGS. 9A and 9B depict the movement of users within the first area in accordance with a second embodiment.
Figure 9A:
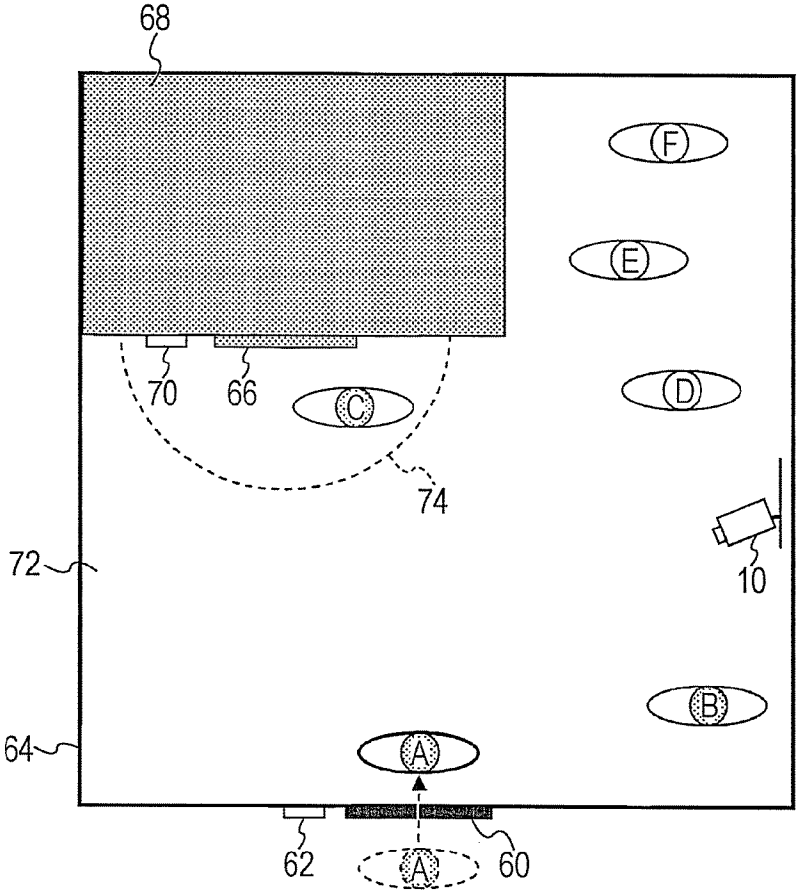

An authentication process of a second embodiment is described below with reference to FIGS. 9A and 9B. FIGS. 9A and 9B illustrate the movements of users within the first area in accordance with the second embodiment. FIGS. 9A and 9B illustrate the statuses of the users for exemplary purposes only, and the various embodiments are not limited to the statuses of the users depicted herein. In FIGS. 9A and 9B, elements identical to those depicted in FIGS. 4A and 4B are designated with the same reference numerals and the discussion thereof is omitted here.

A user successfully authenticated through the first authentication may get close to or in physical contact with another user prior to the second authentication, and the ID of that successfully authenticated user can be superseded by the ID of the other user. The embodiment prevents such ID switching.

The case where the ID of a user and the ID of another user can be switched is described here. As FIG. 4A, FIG. 9A depicts the state in which the user A has passed the first authentication. Five users including the users A-F are within the first room 64 as the first area. A person tracking table 102 (FIG. 11) is produced on a per user basis, and the person tracking device 10 stores the movement information.

The user A gets close to the user B on the way to the second door 66 in order to enter the second room 68 as the second area. In this way, there is a possibility that the ID of the user A is superseded by the ID of the user B in the person tracking device 10 tracking the movement of each user. In other words, the user A and the user B are present within a certain distance, and are present at the same coordinates, and the person tracking device 10 cannot discriminate the user A from the user B. Although the user A moves, the person tracking device 10 stores the movement information of the user A on a person tracking table 102 (FIG. 11) for the user B. ID switching thus takes place.

If the user A approaches the second authentication apparatus 70 with the person tracking device 10 recognizing the user A and the user B with the IDs thereof erroneously switched, the person tracking device 10 determines that the user B has moved. More specifically, a person tracking table 102 for the user A stores the movement data of the user B. If the user A attempts to be authenticated, the person tracking device 10 erroneously determines that the user B and the user C are present within the detection area 74 in the tracking information as depicted in FIG. 9B. The user A and the user C are actually present within the detection area 74. As a result, the second authentication apparatus 70 fails to read the registration information of the user A from the user registration database 6 and the user A can fail to be authenticated.

Figure 10:
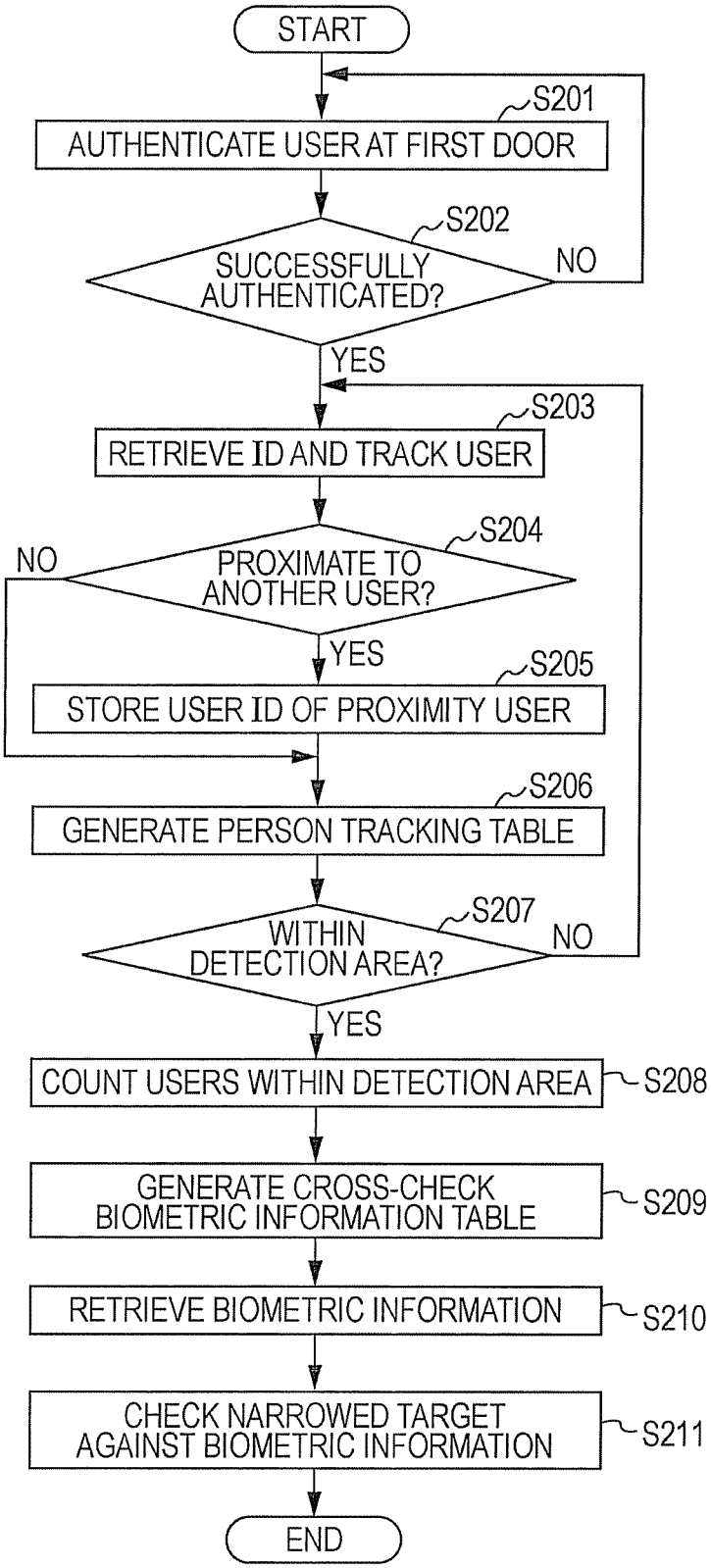
FIG. 10 is a flowchart illustrating a narrowing process of check targets in accordance with the second embodiment.

The authentication process of the second embodiment is described below with reference to FIG. 10. FIG. 10 is a flowchart illustrating the narrowing operation of the check targets in accordance with the second embodiment. The process content and process steps depicted in FIG. 10 is presented for exemplary purposes only, and the various embodiments are not limited to the process content and the process steps depicted here.

The authentication process of the embodiment prevents the above-described ID switching from taking place, and the user from suffering from the user authorization failure as a result. To this end, the registration information of the nearby user is also read from the user registration database during the narrowing operation of the check targets and set to be a check target.

The process steps subsequent to the first authorization of the first authentication apparatus 62 to the tracking of the authenticated user with the user ID acquired (steps S201-S203) are respectively identical to steps S101-S103 in FIG. 5, and the discussion thereof is omitted here.

The person tracking device 10 constantly monitors the user A moving from the first door 60 to the second door 66, thereby determining whether another user gets close to the user A (step S204). If another user comes within a predetermined proximity range of the position of the user A, the person tracking device 10 determines the proximity as one that can cause user ID switching. For example, the person tracking device 10 in the tracking process thereof may recognize the position of the user A at coordinates (Xa,Ya) while also recognizing another user at the same position at the coordinates (Xa,Ya) or a position in the vicinity of the coordinates (Xa, Ya) at the same time. The person tracking device 10 thus determines that the other user is in the proximity of the user A. More specifically, in the tracking process, the person tracking device 10 compares the position coordinates and time information of the person tracking tables 102 (FIG. 11) of the users, and then determines whether another user is present at the same time or within a predetermined time difference, and at the same coordinates or within a predetermined range of the same coordinates.

In the proximity determination, half the width dimension across the body of the user may be used as a distance indicating the predetermined range centered on the user.

If it is determined that the other user is in the proximity of the user A (YES in step S204), the ID number of the other user is stored (step S205), and the person tracking table 102 (FIG. 11) containing that ID number is produced (step S206). This tracking process continues until the user A as a check target enters the detection area 74 as a predetermined area near the second door 66 (step S207).

When the presence of the user A within the detection area 74 near the second door 66 is detected (YES in step S207), a counting operation for counting the users within the detection area 74 is performed (step S208). In step S209, the registration information of the users counted herein is retrieved and listed from the user registration database 6 to produce a crosscheck biometric information table 120 (FIG. 12). In the counting operation, the users in the proximity of the user A recorded on the person tracking table 102 (FIG. 11) are also counted.

Referring to FIG. 9B, the two users, namely, the user A and the user C, present within the detection area 74 are counted if the user A is within the detection area 74. The user B, whom the user A has gotten close to on the way from the first door 60 to the second door 66, is also counted as a check target.

The second authentication apparatus 70 then retrieves the biometric information of the user A (step S210). In the authentication process, the retrieved biometric information is checked against the biometric information registered on the crosscheck biometric information table 120 (FIG. 12) in step S211. The checking method of the biometric information and the criterion of authentication remain unchanged from the above-described embodiment.

The structure of information tables is described below with reference to FIGS. 11 and 12. FIG. 11 depicts one example of person tracking table in accordance with the second embodiment. FIG. 12 depicts one example of crosscheck biometric information table in accordance with the second embodiment. The registration information and the structure of the tables in FIGS. 11 and 12 are presented for exemplary purposes only, and the various embodiments are not limited to the registration information and the structure of the tables depicted herein.

The person tracking tables 102 (1021, 1022, . . . , 102N) depicted in FIG. 11 are respectively produced for the users having successfully authenticated by the first authentication apparatus 62. The person tracking table 102 of the embodiment contains not only a record of the ID number of a user, present position (coordinates) 106 from the person tracking device 10, and time information 108 at the present position, but also a record of ID proximity information 110 indicating whether the user has gotten close to another user, and a proximity ID number 112 of the other user in proximity. The storage of the movement information onto the person tracking table 102 and the sampling of the movement information by the person tracking device 10 may be performed at predetermined time intervals, for example, every minute. The various embodiments are not limited to this method. The sampling of the position information, the time information, etc. may be performed each time the user gets close to another user.

The check targets successfully authenticated through the first authentication are narrowed to the users counted as being present within the detection area 74 and another user, whom the user of interest has gotten close to. Referring to FIG. 12, the crosscheck biometric information table 120 contains the ID number 122, position (coordinates) 124, time information 126, and biometric information data 128 of a counted user, and further the proximity ID number 130 and biometric information data 132 of a proximity user.

The crosscheck biometric information table 120 depicted in FIG. 12 shows an example in which the person tracking device 10 does not switch user ID even with the user A getting close to the user B, and determines that the user A is present within the detection area 74. Since the biometric information data of the user A is stored on the crosscheck biometric information table 120, the user A is successfully authenticated by the second authentication apparatus 70.

Conversely, if use ID switching takes place with the user A getting close to the user B, the person tracking device 10 determines that the user A is present within the detection area 74. In fact, the user B rather than the user A may be present within the detection area 74. In this case, as well, the crosscheck biometric information table 120 depicted in FIG. 12 stores the registration information of the user B (ID number 002) in the proximity of the user A (ID number 001), and the user B is successfully authenticated by the second authentication apparatus 70.

If the check target gets close to or in physical contact with another person, a tracking or of IDs assigned to the check targets may take place and an authentication error as a result of ID switching may cause the check target to suffer from authentication failure. The embodiment lowers the possibility of such errors. Furthermore, the check time is substantially reduced. The possibility of an error of allowing a third person to be accepted is also reduced.

(Third Embodiment)

Figure 13B:
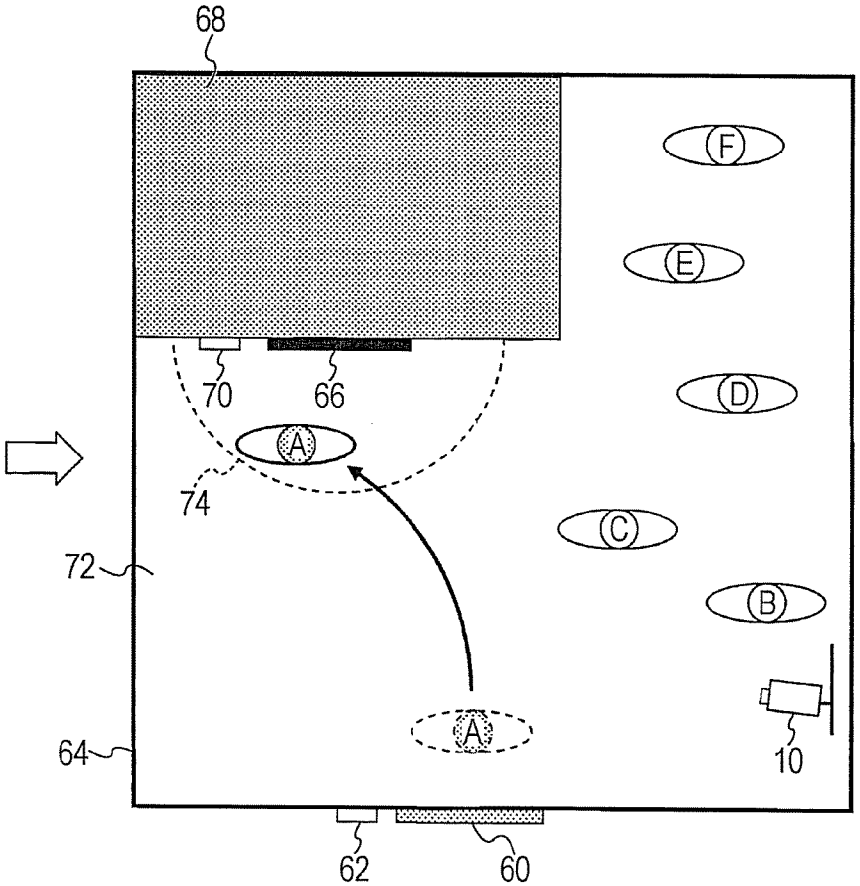
FIGS. 13A and 13B illustrate the movement of users within the first area in accordance with a third embodiment.
Figure 13A:
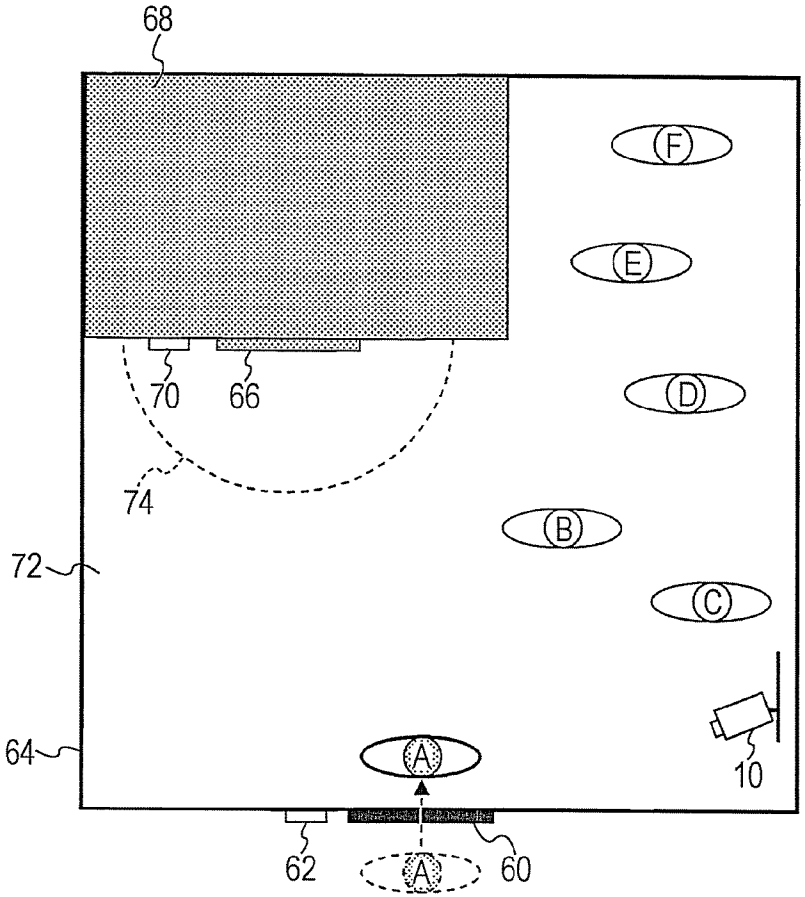

A third embodiment is described with reference to FIGS. 13A and 13B, 14 and 15. FIGS. 13A and 13B illustrate the movements of the user within the first area in accordance with the third embodiment. FIG. 14 depicts one example of crosscheck biometric information table. FIG. 15 depicts an example of crosscheck biometric information table. The examples depicted in FIGS. 13A and 13B, 14 and 15 are presented for exemplary purposes only, and the various embodiments are not limited to the examples depicted herein. In FIGS. 13A and 13B, elements identical to those depicted in FIGS. 9A and 9B are designated with the same reference numerals, and the discussion thereof is omitted herein.

In accordance with the embodiment, the check targets are narrowed depending on whether a user wishing to pass through the second door 66 and moving through the target tracking area 72, is approached to within a predetermined distance by another user.

Referring to FIG. 13A, the authentication process at the first door 60 remains unchanged from that of the above-described embodiments. Referring to FIG. 13B, five persons A-F in addition to the user A are within the target tracking area 72. The person tracking device 10 tracks each user, and a person tracking table 140 is produced as depicted in FIG. 14.

The tracking process to the user A proceeding to the detection area 74 remains unchanged from the tracking process in the second embodiment. As each user moves, ID number 141, present position (coordinates) 142, time information 144. ID proximity information 146 indicating whether another user has gotten close, and proximity ID number 148 are registered for each user in each of the person tracking tables 140 (1401, 1402, . . . , 140N).

In the authentication process, the second authentication apparatus 70 at the second door 66 references tracking history of the user A if the user A enters the detection area 74, and counts users who have gotten close to the user A within a predetermined distance. If the count results show any user who has gotten close to the user A, the biometric information of that user in the proximity of the user A is acquired from the user registration database 6 in order to narrow the check targets.

Referring to FIG. 15, a crosscheck biometric information table 150 is produced. The second authentication apparatus 70 performs the authentication process by checking the biometric information stored on the crosscheck biometric information table 150 against the biometric information of the user A. The authentication method of the embodiment remains unchanged from that of the preceding embodiments.

Referring to FIG. 13B, the user A is not close to another user within the target tracking area 72. Data of the user A only is registered on the crosscheck biometric information table 150, and the second authentication apparatus 70 simply performs the 1:1 checking operation.

If either the user B or the user C is within a predetermined distance of the user A or in physical contact with the user A in the target tracking area 72, the ID numbers and time information of the user B and the user C are recorded on a person tracking table 140 for the user A, and the biometric information with these ID numbers mapped thereto is recorded on the crosscheck biometric information table 150. Referring to FIG. 15, the crosscheck biometric information table 150 lists the users present within the detection area 74 without discriminating the user and the other user who has gotten close to the user while in motion. In the authentication process, the biometric information of the users listed is checked against the biometric information acquired from the second authentication apparatus 70.

If the check target gets close to or in physical contact with another person, a tracking error of IDs assigned to the check targets may take place and an authentication error as a result of ID switching may cause the check target to suffer from authentication failure. The embodiment lowers the possibility of such errors. The embodiment eliminates the need to arrange a particular authentication area, and the authentication process is thus simplified. Furthermore, the check time is substantially reduced. The possibility of an error of allowing a third person to be accepted is also reduced.

The features of the above-described embodiments are described below.

(1) In accordance with the above-described embodiments, the check time is shortened in the biometric authentication for individuals by narrowing the check targets.

(2) For example, 100 persons may be present on the same floor after passing the first door. Let r represent the rate of acceptance of a third person with a check time of 0.3 seconds per person, the process time becomes 30 seconds at the 1:N authentication, and the third person acceptance rate becomes 100r. In accordance with the above-described embodiments, the check targets are narrowed to the person close to the second door and the proximity persons on the way to the second door. If the number of check targets is narrowed to 10 persons, the check time and the third person acceptance rate becomes one-tenth.

(3) In accordance with the above-described embodiments, the authentication process is performed with the check targets narrowed, a high authentication accuracy is maintained on a large number of users without the need to change the engine of the authentication apparatus.

(4) The authentication apparatus of the above-described embodiment frees the user from carrying the RFID tag, ID card, etc. Missing and theft cause no problem in authentication security. Since the user is free of memorizing and inputting the ID, no ID input failure takes place. The user's psychological burden involved is thus lightened.

(5) Even if the ID switching of the users take place, the possibility of an authentication error such as a failure to recognize correctly the user is lowered.

(Other Embodiments)

(1) If the ID switching of the users can be caused when one user in motion approaches another user, the ID of the other user in the proximity of the one user is also registered on the crosscheck biometric information table 120 for checking as depicted in FIG. 12. In accordance with another embodiment, the biometric information data 132 of the proximity ID number 130 of the proximity user on the crosscheck biometric information table 120 may set to have a higher authentication threshold value in the checking process. A replacement user as a result of the ID switching may attempt to forge the biometric information of the registered user and to be authenticated. The above-described arrangement tightens the authentication criteria on the user having proximity information, thereby preventing a third person from being accepted.

(2) In accordance with the above-described embodiments, the ID of the proximity user is registered on the person tracking table and is included as a check target as depicted in FIG. 11. The registered proximity user may have gotten close to or in physical contact with another user, and registered as a proximity ID of the other user on the person tracking table. In one embodiment, such information may be continuously registered on the person tracking table. The ID switching of the proximity user may have already took place. As the number of times of proximities and the number of proximity users increase, the increase in the possibility of occurrence of the third person acceptance error during authentication is reduced.

The embodiments can be implemented in computing hardware (computing apparatus) and/or software, such as (in a non-limiting example) any computer that can store, retrieve, process and/or output data and/or communicate with other computers. The results produced can be displayed on a display of the computing hardware. A program/software implementing the embodiments may be recorded on computer-readable media comprising computer-readable recording media. The program/software implementing the embodiments may also be transmitted over transmission communication media. Examples of the computer-readable recording media include a magnetic recording apparatus, an optical disk, a magneto-optical disk, and/or a semiconductor memory (for example, RAM. ROM, etc.). Examples of the magnetic recording apparatus include a hard disk device (HDD), a flexible disk (FD), and a magnetic tape (MT). Examples of the optical disk include a DVD (Digital Versatile Disc), a DVD-RAM, a CD-ROM (Compact Disc-Read Only Memory), and a CD-R (Recordable)/RW. An example of communication media includes a carrier-wave signal.

Further, according to an aspect of the embodiments, any combinations of the described features, functions and/or operations can be provided.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. An authentication apparatus, comprising:

a memory that stores authentication information representing a check target; and a processor that executes a program including:

first authenticating the check target at an entrance of the check target to a first area;

tracking the check target in the first area;

second authenticating the check target at an entrance of the check target to a second area after being authenticated by the first authenticating; and detecting a check target present in a detection area and expected to be authenticated by the second authenticating, wherein the second authenticating retrieves, from the memory, registration information of the check target detected by the detecting and authenticates the check target authenticated by the first authenticating using the registration information, wherein the detecting detects, in accordance with tracking information from the tracking, that the check target has gotten close to or in physical contact with another check target, and wherein the second authenticating retrieves, from the memory, registration information of the other check target that the check target has gotten close to or in physical contact with, together with the registration information of the detected check target, and authenticates the check target using the retrieved registration information.

2. The authentication apparatus according to claim 1, further comprising a storage unit storing target information representing the check target authenticated at the entrance of the check target to the first area, and wherein the second authenticating authenticates the check target at the entrance of the check target to the second area using the target information stored on the storage unit.

3. The authentication apparatus according to claim 1, wherein the authentication information comprises biometric information representing the check target.

4. The authentication apparatus according to claim 1, wherein the tracking monitors whether the authenticated check target gets close to or in physical contact with the other check target based on position information and/or time information of the check target being tracked.

5. An authentication method executed by an authentication apparatus, comprising:

registering, on a registration unit, authentication information representing a check target;

performing a first authentication on the check target at an entrance of the check target to a first area;

tracking the check target in the first area;

detecting a check target present in a detection area and expected to be authenticated in a second authentication, the second authentication to be performed on the check target authenticated in the first authentication at an entrance to a second area; and performing the second authentication using registration information of the detected check target, the registration information being retrieved from the registration unit, wherein the detecting includes detecting in accordance with tracking information obtained in the tracking that the check target has gotten close to or in physical contact with another check target, and wherein the second authentication includes retrieving, from the registration unit, registration information of the other check target that the check target has gotten close to or in physical contact with, together with the registration information of the detected check target.

6. The authentication method according to claim 5, the method further comprising storing target information representing the check target authenticated at the entrance of the check target to the first area, and wherein the second authentication includes authenticating the check target at the entrance of the check target to the second area using the stored target information.

7. The authentication method according to claim 5, wherein the authentication information comprises biometric information representing the check target.

8. The authentication method according to claim 5, wherein the tracking comprises monitoring whether the authenticated check target gets close to or in physical contact with the other check target based on position information and/or time information of the check target being tracked.

9. A computer-readable storage medium having stored a program, the program causing an authentication apparatus to perform a method of the authentication apparatus, the method comprising:

registering, on a registration unit, authentication information representing a check target;

performing a first authentication on the check target at an entrance of the check target to a first area;

tracking the check target in the first area;

detecting a check target present in a detection area and expected to be authenticated in a second authentication, the second authentication to be performed on the check target authenticated in the first authentication at an entrance to a second area; and performing the second authentication using registration information of the detected check target, the registration information being retrieved from the registration unit, wherein the detecting includes detecting in accordance with tracking information obtained in the tracking that the check target has gotten close to or in physical contact with another check target, and wherein the second authentication includes retrieving, from the registration unit, registration information of the other check target that the check target has gotten close to or in physical contact with, together with the registration information of the detected check target.

10. The computer-readable storage medium according to claim 9, the method further comprising storing target information representing the check target authenticated at the entrance of the check target to the first area, and wherein the second authentication includes authenticating the check target at the entrance of the check target to the second area using the stored target information.

11. The computer-readable storage medium according to claim 9, wherein the authentication information comprises biometric information representing the check target.

12. The computer-readable storage medium according to claim 9, wherein the tracking comprises monitoring whether the authenticated check target gets close to or in physical contact with the other check target based on position information and/or time information of the check target being tracked.

* * * * *

UNITED STATES PATENT AND TRADEMARK OFFICE

CERTIFICATE OF CORRECTION

PATENT NO. : 8,638,231 B2
APPLICATION NO. : 12/572608
DATED : January 28, 2014
INVENTOR(S) : Zheng et al.

It is certified that error appears in the above-identified patent and that said Letters Patent is hereby corrected as shown below:

On the Title Page, Item (54) and in the Specification, in Column 1, Line 3, Delete "COMPUTER READABLE" and insert -- COMPUTER-READABLE --, therefor.

Signed and Sealed this
Twenty-ninth Day of April, 2014

Michelle K. Lee

Michelle K. Lee
*Deputy Director of the United States Patent and Trademark Office*